US011180867B2

(12) United States Patent
Sarabia-Riquelme

(10) Patent No.: US 11,180,867 B2
(45) Date of Patent: Nov. 23, 2021

(54) CONTINUOUS WET-SPINNING PROCESS FOR THE FABRICATION OF PEDOT:PSS FIBERS WITH HIGH ELECTRICAL CONDUCTIVITY, THERMAL CONDUCTIVITY AND YOUNG'S MODULUS

(71) Applicant: University of Kentucky Research Foundation, Lexington, KY (US)

(72) Inventor: Ruben Sarabia-Riquelme, Lexington, KY (US)

(73) Assignee: University of Kentucky Research Foundation, Lexington, KY (US)

( * ) Notice: Subject to any disclaimer, the term of this patent is extended or adjusted under 35 U.S.C. 154(b) by 159 days.

(21) Appl. No.: 16/690,397

(22) Filed: Nov. 21, 2019

(65) Prior Publication Data

US 2020/0299863 A1 Sep. 24, 2020

Related U.S. Application Data

(60) Provisional application No. 62/821,012, filed on Mar. 20, 2019.

(51) Int. Cl.

| | |
|---|---|
| ***D01D 10/06*** | (2006.01) |
| ***D01D 5/06*** | (2006.01) |
| ***D01F 6/14*** | (2006.01) |
| ***D01D 5/12*** | (2006.01) |
| ***D01D 5/16*** | (2006.01) |
| ***D01F 6/56*** | (2006.01) |

(Continued)

(52) U.S. Cl.

CPC ..... *D01D 5/06* (2013.01); *D01D 5/12* (2013.01); *D01D 5/16* (2013.01); *D01F 6/14* (2013.01); *D01F 6/56* (2013.01); *D01F 6/96* (2013.01); *D02J 1/223* (2013.01); *D02J 1/224* (2013.01); *D02J 1/229* (2013.01); *D01D 1/02* (2013.01); *D01F 1/10* (2013.01); *D01F 6/18* (2013.01); *D06M 2101/20* (2013.01); *D10B 2401/16* (2013.01)

(58) Field of Classification Search

CPC .. D01D 5/06; D01D 5/12; D01D 5/16; D01D 10/06; D01F 6/56; D01F 6/96; D02J 1/223; D02J 1/224; D02J 1/229; D10B 2401/16

USPC ..... 264/104, 184, 210.8, 211.14, 331.11, 264/331.12, 331.17, 342 RE

See application file for complete search history.

(56) References Cited

U.S. PATENT DOCUMENTS

| | | | |
|---|---|---|---|
| 4,400,339 | A | 8/1983 | Reinehr et al. |
| 6,824,718 | B2 | 11/2004 | Eitzman et al. |

(Continued)

FOREIGN PATENT DOCUMENTS

| | | | |
|---|---|---|---|
| CN | 106381571 | A | 2/2017 |
| WO | 2007099889 | A1 | 9/2007 |

(Continued)

OTHER PUBLICATIONS

English machine translation of CN106381571A dated Feb. 8, 2017.

(Continued)

*Primary Examiner* — Leo B Tentoni

(74) *Attorney, Agent, or Firm* — Stites & Harbison PLLC; Warren D. Schickli

(57) ABSTRACT

A method of wet spinning poly (3,4-ethylenedioxythiopene): poly (styrenesulfonate) or PEDOT:PSS fibers produces PEDOT:PSS fibers having a unique combination of electrical conductivity, thermal conductivity and Young's modulus properties.

19 Claims, 12 Drawing Sheets

(51) Int. Cl.

| | |
|---|---|
| ***D01F 6/96*** | (2006.01) |
| ***D02J 1/22*** | (2006.01) |
| *D06M 101/20* | (2006.01) |
| *D01F 6/18* | (2006.01) |
| *D01D 1/02* | (2006.01) |
| *D01F 1/10* | (2006.01) |

(56) References Cited

U.S. PATENT DOCUMENTS

| | | | |
|---|---|---|---|
| 7,628,944 | B2 | 12/2009 | Mattes et al. |
| 9,296,889 | B2 | 3/2016 | Francalanci et al. |
| 9,370,096 | B2 | 6/2016 | Frey et al. |
| 9,722,249 | B2 | 8/2017 | Lovenich et al. |
| 10,087,553 | B1 | 10/2018 | Nagarajan et al. |
| 10,263,169 | B2 | 4/2019 | Gong et al. |
| 2004/0207126 | A1 | 10/2004 | Czado |
| 2007/0085061 | A1 | 4/2007 | Elder et al. |
| 2010/0164478 | A1* | 7/2010 | Miura ..... H02N 1/004 324/109 |
| 2012/0175564 | A1 | 7/2012 | Jin et al. |
| 2017/0002482 | A1 | 1/2017 | Wilkinson |
| 2017/0370024 | A1 | 12/2017 | Zhou et al. |
| 2018/0009957 | A1 | 1/2018 | Greco et al. |
| 2018/0251914 | A1 | 9/2018 | Qiu et al. |

FOREIGN PATENT DOCUMENTS

| | | | |
|---|---|---|---|
| WO | 2014090394 | A1 | 6/2014 |
| WO | 2018043807 | A1 | 3/2018 |

OTHER PUBLICATIONS

English machine translation of WO2007099889A1 dated Sep. 7, 2007.

English machine translation of W02018043807A1 dated Mar. 8, 2018.

* cited by examiner

CONTINUOUS WET-SPINNING PROCESS FOR THE FABRICATION OF PEDOT:PSS FIBERS WITH HIGH ELECTRICAL CONDUCTIVITY, THERMAL CONDUCTIVITY AND YOUNG'S MODULUS

RELATED APPLICATION

This application claims priority to U.S. Provisional Patent Application 62/821,012 filed on Mar. 2, 2019, is hereby incorporated by reference in its entirety.

TECHNICAL FIELD

This document relates generally to processes for the wet-spinning of fibers and, more particularly, to a new and improved process for wet-spinning poly (3,4-ethylenedioxythiopene):poly (styrenesulfonate) (PEDOT:PSS) fibers as well as to PEDOT:PSS fibers characterized by a unique combination of electrical conductivity, thermal conductivity and Young's modulus properties.

BACKGROUND

Smart electronic textiles cross conventional applications to impart functionalities such as light emission, health monitoring, climate control, sensing, storage and conversion of energy, etc. However, to realize these smart textile devices, new fibers and yarns that are electrically conductive and mechanically robust are needed as fundamental building blocks.

Conjugated polymers have gained attention in the field of electronic textiles because they are made of earth-abundant elements, have good mechanical properties and flexibility, and they can be processed using low-cost large-scale solution processing methods. Currently, the main method to fabricate electrically conducting fibers or yarns from conjugated polymers is the deposition of the conducting polymer onto an inert fiber support by using different techniques. Coated fibers have the advantage of being relatively straight forward to fabricate and retain the mechanical properties of the support polymer fibers. However, the bulk electrical conductivity of these coated textiles is usually small (often lower than 10 S $cm^{-1}$) which limits their applications.

An interesting alternative would be to fabricate electrically conductive and robust conjugated polymer fibers that could serve as building blocks for electronic textiles. Aqueous dispersions of PEDOT:PSS can be processed into fibers using a traditional wet-spinning process where the polymer solution (dope) is coagulated using a non-solvent. Past efforts to improve the electrical conductivity have focused upon removing the excess of insulating PSS either by post-treatments with ethylene glycol or by coagulating the fiber using sulfuric acid.

Drawing or stretching is a characteristic step of every fiber fabrication process. Drawing induces preferential orientation of the polymer chains in the fiber-axis direction enhancing the mechanical properties of the fiber. Moreover, increased electrical conductivity with increasing draw has been previously reported for other conducting polymer fibers such as poly(3-alkylthiophenes) and polyaniline fibers. In addition to the mechanical properties and electrical conductivity, other transport properties such as the thermal conductivity and Seebeck coefficient are also of great interest for electronic textiles and can also be affected by the preferential orientation of the polymer chains. For instance, the thermal conductivity at room temperature of an oriented polyacetylene film was measured to be ~13 W $m^{-1}$ $K^{-1}$, while oriented polyethylene fibers may achieve values higher than 30 W $m^{-1}$ $K^{-1}$ above 200 K. On the other hand, the effect of orientation on the Seebeck coefficient is less clear and it has been reported to decrease, remain the same or increase with increased orientation in conjugated polymer films.

This document relates to a new and improved continuous wet-spinning process that produces PEDOT:PSS fibers characterized by a unique combination of useful electrical conductivity, thermal conductivity and Young's modulus properties.

SUMMARY

In accordance with the purposes and benefits described herein, a method is provided for the wet spinning of PEDOT:PSS fibers. That method comprises the steps of: (a) extruding a dispersion of PEDOT:PSS polymer in a polar solvent through a spinneret into a coagulation bath of non-solvent to the PEDOT:PSS and a polar solvent having a boiling point above 100° C. to produce PEDOT:PSS fibers, (b) taking up the PEDOT:PSS fibers out of the coagulation bath, (c) drying the PEDOT:PSS fibers as the PEDOT:PSS fibers are taken up from the coagulation bath, (d) drawing the PEDOT:PSS fibers in a stretch bath and (e) recovering the PEDOT:PSS fibers from the stretch bath.

An optional washing step may be provided between the drying step (c) and the drawing step (d). More particularly, the washing step includes washing the PEDOT:PSS fibers in a washing bath and recovering the PEDOT:PSS fibers from the washing bath. The recovering step (e) includes the steps of drying the PEDOT:PSS fibers with air at a temperature of between 80° C. and 250° C. prior to winding up the PEDOT:PSS fibers on a rotating spool.

The method may also include continuously processing the PEDOT:PSS fibers through the extruding, taking up, washing, drying, drawing and recovering steps.

In one or more of the many possible embodiments of the method, the method includes providing between 1 to 10 weight percent solids in the dispersion of PEDOT:PSS polymers.

In one or more of the many possible embodiments of the method, the method includes including 0.1-80% volume polar solvent and 20-99.9% volume non-solvent in the coagulation bath. In one or more of the many possible embodiments of the method, the method includes including 0.1-20% volume polar solvent and 80-99.9% volume non-solvent in the coagulation bath. In one or more of the many possible embodiments of the method, the method includes including 5-10% volume polar solvent and 90-95% volume non-solvent in the coagulation bath.

In any or all of these possible embodiments, the polar solvent may be selected from a first group consisting of dimethyl sulfoxide, ethylene glycol, glycerol and combinations thereof. In any or all of these possible embodiments, the non-solvent may be selected from a second group consisting of acetone, isopropanol and combinations thereof.

The method may include using a rotating roller for the taking up of the PEDOT:PSS fibers. In such embodiments, the drying of the PEDOT:PSS fibers is performed between the coagulation bath and the rotating roller. Further, that drying may be completed using air having a temperature of between 80° C. to 150° C.

The method may also include the step of maintaining the stretch bath at a temperature above 0° C. and below the boiling point of the polar solvent used in the stretch bath. In one or more of the many possible embodiments of the method, that polar solvent has a boiling point above 100° C. In one or more of the many possible embodiments of the method, the polar solvent is selected from a third group consisting of dimethyl sulfoxide, ethylene glycol, glycerol and combinations thereof.

In accordance with yet another aspect, a method of wet spinning of PEDOT:PSS fibers comprises the steps of (a) extruding a dispersion of PEDOT:PSS polymer in a polar solvent through a spinneret into a coagulation bath of non-solvent to the PEDOT:PSS, (b) taking up the PEDOT:PSS fibers out of the coagulation bath, (c) drawing the PEDOT:PSS fibers in a stretch bath of a polar solvent having a boiling point above 100° C. and (d) recovering the PEDOT:PSS fibers from the stretch bath.

In one or more of the many possible embodiments, the method may include the step of selecting the polar solvent from a group consisting of dimethyl sulfoxide, ethylene glycol, glycerol and combinations thereof. Further, the stretch bath may be maintained at a temperature between 0° C. and 150° C. while stretching the PEDOT:PSS fibers at a ratio of between 0.9:1 and 5:1.

In one or more of the many possible embodiments, the method may include selecting the non-solvent from a group consisting of acetone, isopropanol and combinations thereof.

In accordance with still another aspect, a new composition of matter is provided comprising PEDOT:PSS fibers having electrical conductivity between 100 and 2500 S/cm, thermal conductivity of between 1 and 15 W/mK and a Young's modulus of between 4 and 16 GPa.

In the following description, there are shown and described several embodiments of the new method and the new composition of matter. As it should be realized, the method and composition of matter are capable of other, different embodiments and their several details are capable of modification in various, obvious aspects all without departing from the method and composition of matter as set forth and described in the following claims. Accordingly, the drawings and descriptions should be regarded as illustrative in nature rather than restrictive.

BRIEF DESCRIPTION OF THE DRAWING FIGURES

The accompanying drawing figures incorporated herein and forming a part of the specification, illustrate several aspects of the method and together with the description serve to explain certain principles thereof.

DETAILED DESCRIPTION

Figure 1:
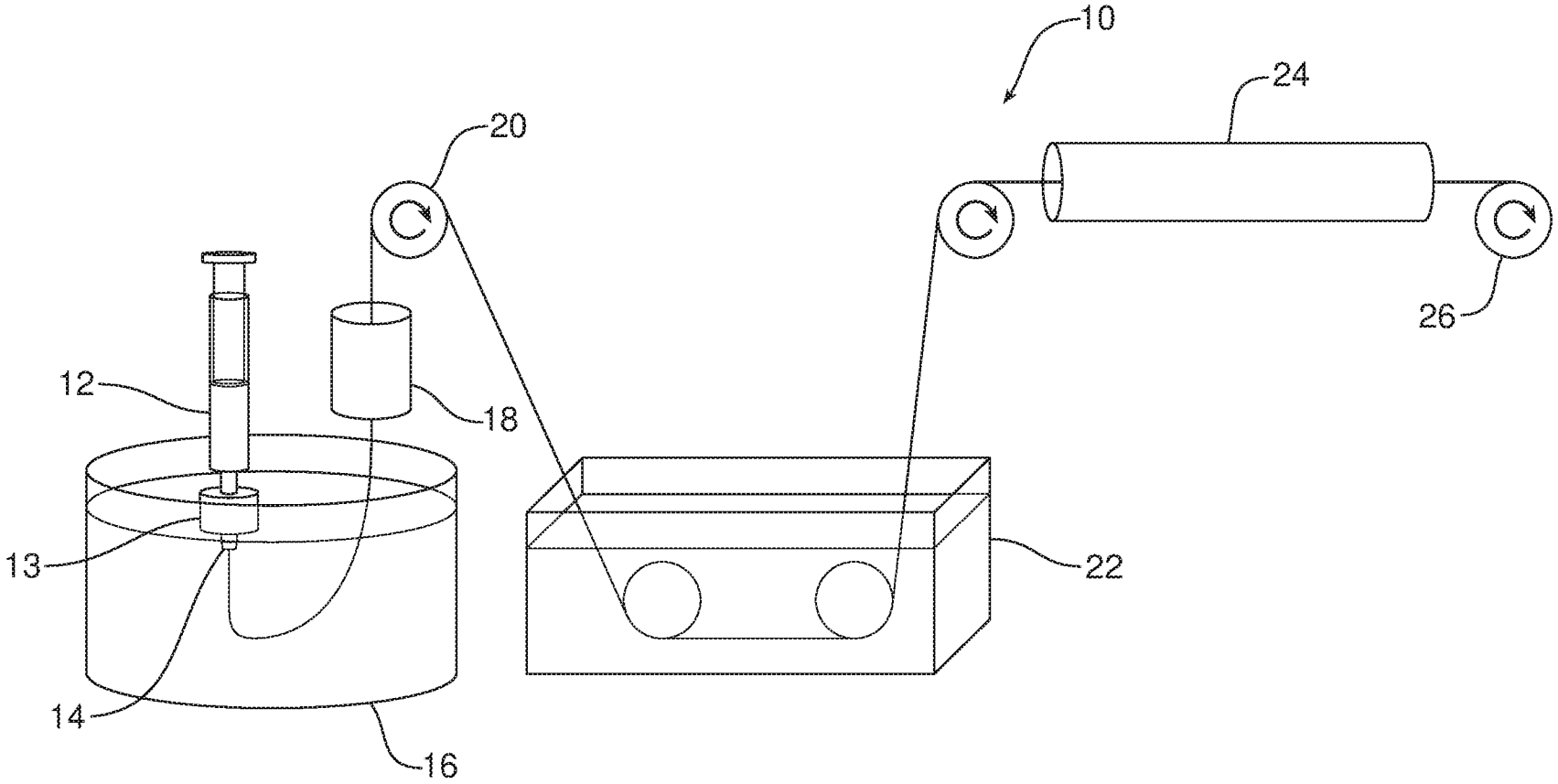
FIG. 1 is a schematic illustration of the continuous wet-spinning process for the fabrication of PEDOT:PSS fibers.

A continuous wet-spinning process allows for the fabrication of poly(3,4-ethylenedioxythiophene):poly(styrenesulfonate) (PEDOT:PSS) fibers with high electrical conductivity, thermal conductivity and Young's modulus.

In this process a dispersion of the conducting polymer PEDOT:PSS in a polar solvent (for example, water) is extruded through a spinneret into a coagulation bath of non-solvent to the polymer (for example, acetone, isopropanol (IPA) or mixtures thereof). Such dispersion can have between 1 to 10 wt. % solids, between 1 to 5 wt. % solids and more preferably between 2 to 3 wt. % solids. In addition to the non-solvent, a high boiling point polar solvent (that is, a polar solvent having a boiling point of greater than 100° C.) may be added (for example, dimethylsulfoxide, ethylene glycol or glycerol or mixtures thereof) to the coagulation bath in a range from 0 to 80 vol. %, more preferably between 0 to 20 vol. % and more preferably between 5 to 10 vol. % with respect to the non-solvent. In this coagulation bath the extruded PEDOT:PSS dispersion coagulates forming solid fibers. The addition of a high boiling point polar solvent, keeping all else process parameters equal, increases the electrical conductivity of the coagulation bath fibers by one order of magnitude and changes its cross-sectional shape from not round to round.

The solid fibers can then be taken up continuously by a rotating roller out of the coagulation bath. Between the coagulation bath and this roller the fibers are dried by using a vertical heater that keeps air temperature between 80° C. to 150° C., more preferably between 100° C. to 120° C. If the fibers are not dried, stickage to the roller due to surface tension of the wet fibers may occur and breakage of the fibers may happen in any attempt to take the fibers further down the process.

Afterwards, the dried fibers enter a draw or stretch bath of a high boiling point solvent (for example, dimethyl sulfoxide, ethylene glycol, glycerol or mixtures thereof) that may be kept at a temperature above room temperature but below the boiling point of the solvent used. This solvent is used as heat transfer media and plasticizer to the fibers allowing the application of high draw ratios. In some embodiments, draw ratios range from 0.9:1 to 5:1. From this stretch bath the fibers are recovered. This can be done by taking the PEDOT:PSS fibers up continuously by a roller without being dried. This draw or stretch step is followed by a drying step where air temperature is kept between 100° C. to 250° C., more preferably between 150° C. and 200° C. After this drying step, the fibers can be continuously taken-up on a spool.

This process results in the production of continuous, mechanically robust and electrically conductive PEDOT:PSS fibers having a unique combination of properties. More particularly, the PEDOT:PSS fibers are characterized by having electrical conductivity between 100 and 2500 S/cm, thermal conductivity of between 1 and 15 W/mK and a Young's modulus of between 4 and 16 GPa. Such PEDOT:

PSS fibers have numerous applications in the emerging field of electronic textiles including, for example, as electrical interconnection in textile circuits, or building block for fiber-shaped supercapacitors or thermoelectric textiles.

EXPERIMENTAL SECTION

Materials.

PEDOT:PSS water dispersion was purchased from Heraeus (PH1000; PEDOT:PSS weight ratio of 1:2.5; solid content 1.3 wt. %). DMSO and IPA were purchased from VWR.

Dope Preparation.

The PEDOT:PSS dispersion was placed in a hot plate at 90° C. while magnetically stirring and the mass of evaporated water was monitored until the solid concentration reached 2.5 wt. %. Afterwards, 5 wt. % of DMSO was added and the dope was further stirred for 2 h at room temperature. Then, the dope was bath sonicated for 30 min and finally degassed in a vacuum oven at room temperature.

Wet-Spinning Process.

FIG. 1 shows a scheme 10 of the wet-spinning set up used in this work. First, the degassed dope was transferred carefully to a 5 cc glass syringe 12 and placed on a syringe pump (KD Scientific) that allowed precise control of the flow rate. A constant flow rate of 0.25 mL/h was used for all the samples collected in this work. The dope passed through a sintered metal disk 13 (syringe filter), with an average pore size of 5 μm, before exiting through a 100 μm diameter capillary spinneret 14 into the coagulation bath 16. In this work two coagulation baths were investigated, pure IPA and 10 vol. % DMSO in IPA. After coagulation, the fiber was dried by a heater 18, that kept air temperature around 120° C., before reaching the first roller 20. The ratio between the first roller speed, $v_1$, and the jet velocity, $v_{jet}$=flow rate/area of the spinneret orifice, is called the jet draw ratio, $DR_{jet}=v_1/v_{jet}$, and was kept constant at 1.50. Coagulation bath samples were taken from this first roller directly into a spool. The additional tension needed to take the sample from the first roller to the spool resulted in total draw ratio of 1.58 for coagulation bath samples. For stretched samples, after the first roller, the fiber entered a pure DMSO stretch or draw bath 22 (kept at room temperature) followed by another drying step in a cylinder-shaped oven 24 with a maximum air temperature inside the oven of 170° C. After the oven, drawn and dried fiber could be continuously taken-up on a spool 26. We defined the ratio between the take-up speed, $V_{take\text{-}up}$, and $v_1$, as the DMSO draw ratio, $DR_{DMSO}=v_{take\text{-}up}/v_1$, and the total draw ratio can then be defined as $DR_{total}=DR_{jet}\cdot DR_{DMSO}$.

Mechanical characterization. Tensile tests were performed using the automatic single-fiber test system FAVIMAT+ from Textechno. The pretension was 0.50 cN/tex and the test speed was 5.0 mm/min over a gauge length of 25.4 mm. Values presented in this work are average values of at least 5 fibers per sample and error bars represent standard deviation between fibers.

Electrical and thermoelectric characterization. Typically, a 30 mm long segment of fiber was laid between two copper tape strips and contacted using silver paint. Then, the resistance was measured by the 2-probe method using a Keithley 2100 microvoltmeter. Initially, we measured resistance using a 4-probe method to eliminate contact resistance. However, the contact resistance was found to be in all cases small (<5%) compared to the total resistance of the specimens. Thus, we decided to switch to a 2-probe method that reduced manipulation of the delicate single-filament samples. The electrical conductivity was calculated from the measured resistance, length and cross-sectional area of each specimen. At least 5 specimens were tested per sample. Values presented in this work are the average values and error bars are the standard deviation between specimens within the same sample.

The Seebeck coefficient was measured using a home-made set up. Typically, three 30 mm long segments of fiber were laid between two Peltier devices that allowed for precise control of the temperature and contacts were made using silver paint. Two K-type thermocouples were used to monitor the cold-side and hot-side temperatures. The Seebeck coefficient was extracted as the slope of the $\Delta V-\Delta T$ plots. Values presented are average values between three specimens and error bars represent standard deviation between specimens within the same sample.

Figure 4:
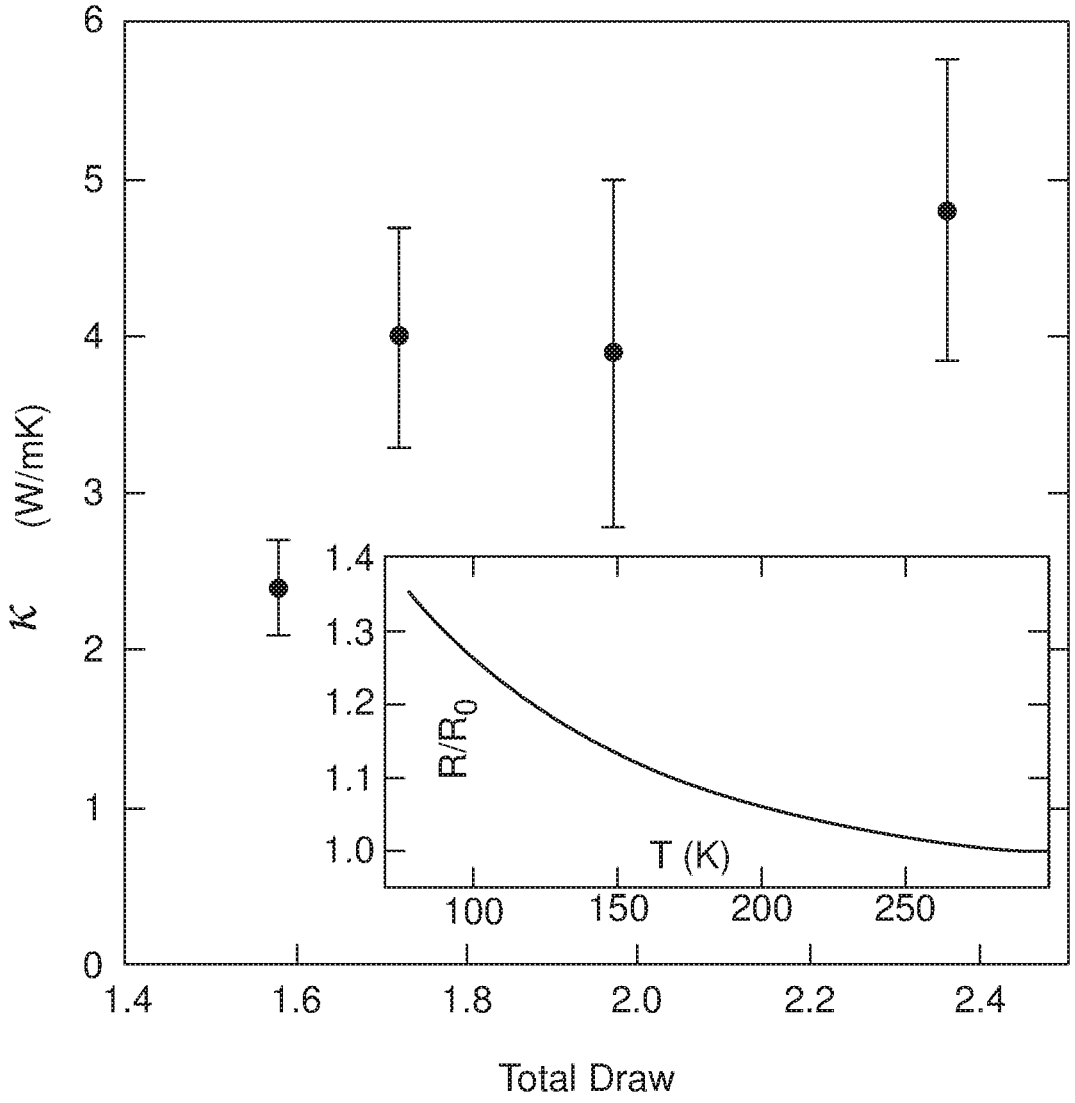
FIG. 4 is an illustration of the average thermal conductivities from samples spun into 10% volume DMSO in IPA at different total draws.

Thermal conductivity characterization. The thermal conductivities, κ, were measured for 3-4 specimens for a coagulation bath sample with total draw of 1.58 and three DMSO stretched samples with total draws of 1.72, 1.97 and 2.36 using a self-heating technique (all samples spun into 10 vol. % DMSO in IPA). In short, the resistance of the specimen, mounted in a four-probe configuration, was measured as a function of applied current. If heat exchange by thermal radiation is negligible, the derivative of the resistance with respect to current (for small currents) is given by:

$$\frac{dR}{dI^2} \approx \frac{RL}{12\kappa A}\frac{dR}{dT} \qquad \text{eq. 1}$$

where L and A are the length and cross-sectional area of the specimen. As shown in the inset of FIG. 4, dR/dT goes to zero near room temperature and the uncertainty associated with thermal radiation becomes large (>100%), so measurements were instead made at liquid nitrogen temperature, where the radiation uncertainty is ~±3%. Also, measurements were done for presumably dehydrated samples in vacuum.

Scanning Electron Microscopy (SEM).

Imaging was performed on a Hitachi S-4800 field emission SEM at 10 kV accelerating voltage and 10 μA beam current. Gold sputtering of the samples was not needed due to the conductive nature of the fibers. Since the electrical conductivity is dependent on diameter, each specimen tested for electrical resistance was then placed in the SEM to obtain its average diameter. For each specimen 10 to 15 diameter values were measured at different points, which gave a total of 50-75 measured values per sample. The average value was taken as the average diameter of the sample and error bars represent the standard deviation within the same sample. In the case of fibers spun into an IPA coagulation bath, the reported diameters are the effective diameters that a hypothetical circular cross-section with same area as the non-circular cross-section would have. For imaging the cross-sections, a bundle of fibers was immersed in liquid nitrogen and fractured using a razor blade. The bundle was then transferred to the SEM for imaging.

Wide-angle x-ray scattering (WAXS). Measurements were performed in transmission mode using the Xenocs Xeuss 2.0 SAXS/WAXS system located at the Electron Microscopy Center of the University of Kentucky. The source was GeniX$^{3D}$ Cu ULD 8 keV with wavelength of 1.54189 Å. Typically, after completing electrical, thermoelectric, mechanical and SEM characterizations, the remaining fibers on the spool were cut and aligned into a bundle and placed in an aperture card. The aperture card with the aligned fiber bundle was then transferred to the WAXS sample holder and placed at 101.17 mm from the 2D detector (Dectris Pilatus 200K). Exposure time was 600 s. Data processing to obtain the integrated diffracted intensity versus 2θ and azimuthal angle, ω, was performed using the software Foxtrot provided by Xenocs. In order to measure the WAXS diffraction pattern of an unoriented PEDOT:PSS sample, a film was prepared by drying some drops of dope on a flat surface at room temperature. The dried film could be peeled off the surface and transferred to the WAXS sample holder for characterization.

Results and Discussion

IPA was chosen as coagulation bath. When the PEDOT:PSS dope entered in the coagulation bath, water diffused from the nascent fiber into the coagulation bath and IPA diffused into it. This caused a fast destabilization of the dispersion because PSS lost its surfactant effect resulting in the formation of a solid filament. In this work the jet draw was kept constant at 1.50. Additionally, a coagulation bath with 10 vol. % DMSO in IPA was also investigated. Following the coagulation bath, the fiber was dried by a vertical heater. Initial tests did not include a heater at this point. However, when the wet fiber touched the first roller, the surface tension between the IPA and the roller stuck the fiber to the roller and breakage would occur in any attempt to take the fiber further down the spinning line. Thus, completely drying the filament before touching the first roller was adopted. Then, the dried filament entered the draw bath. DMSO is a polar solvent that can screen to some extend the coulombic interactions between PEDOT and PSS leading to an enhancement in the local order of PEDOT chains. With this screening effect in mind, we decided to test DMSO as the media to further draw the fibers. In the draw bath, DMSO rapidly swelled the fiber which was clearly visible by the increase in size of the filament. DMSO acted as a plasticizer allowing for the application of high draws to the fiber. Afterwards, the filament was taken out of the DMSO bath by the second roller. At this point, the filament was strong enough to release from the roller without breakage and, therefore, drying the fiber between the DMSO bath and the second roller was not necessary. Finally, the filament was dried by passing through a cylinder-shaped oven before being taken-up on a spool.

Figure 2:
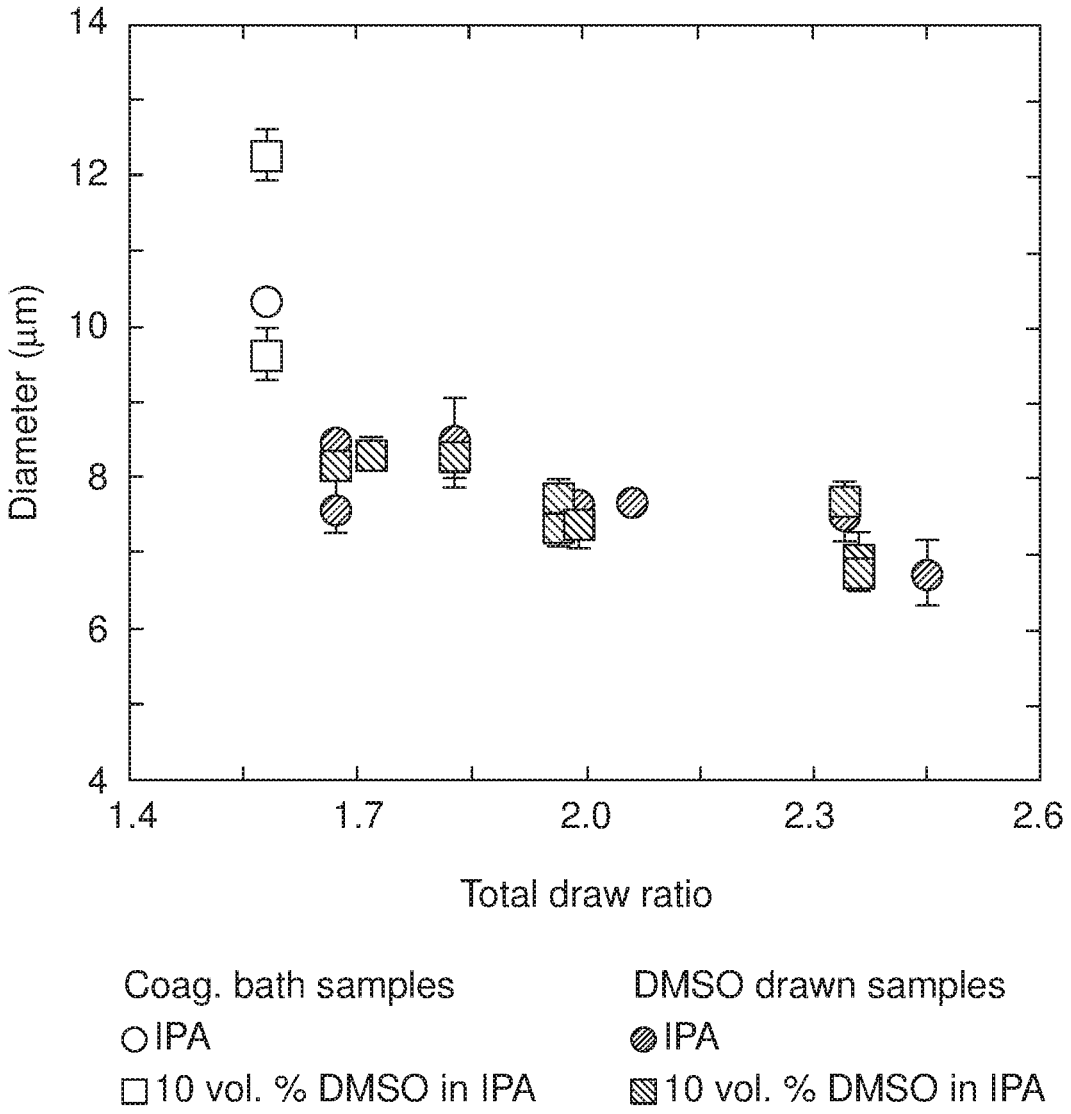
FIG. 2 is a plot of fiber diameter versus total draw ratio of the PEDOT:PSS fibers.

FIG. 2 shows the diameters of the fibers as a function of the total draw ratio. As expected, the diameter of the fibers decreased with increasing draw from 10-12 μm for the coagulation bath samples to 6.7-7 μm for the fibers with the highest applied draws. No difference in diameter was observed between the fibers spun into IPA and 10 vol. % DMSO in IPA. However, a difference in the cross-sectional shape of the fibers was observed. Fibers spun into pure IPA as coagulation bath showed a non-circular cross-section while fibers spun into 10 vol. % DMSO in IPA were all circular. In all cases, high quality fibers with the absence of voids could be spun for hours without breakage.

As expected, the diameter of the fibers decreased with increased draw ratio. Plotted values shown in FIG. 2 are average values of 50-75 diameter measurements performed on 5 different specimens (10-15 per specimen) and error bars represent the standard deviation within specimens of the same sample. The cross-sectional shape was not circular for fibers spun into pure IPA but became circular when 10 vol. % DMSO was added to the coagulation bath.

As expected, the 2D WAXS pattern of a PEDOT:PSS film does not show any signs of preferred orientation, indicating random orientation of the polymer chains. However, in the 2D WAXS patterns of the fibers, the characteristics arcs indicating preferred orientation of crystalline planes could be observed and became more evident at higher draw ratios.

Figure 3A:
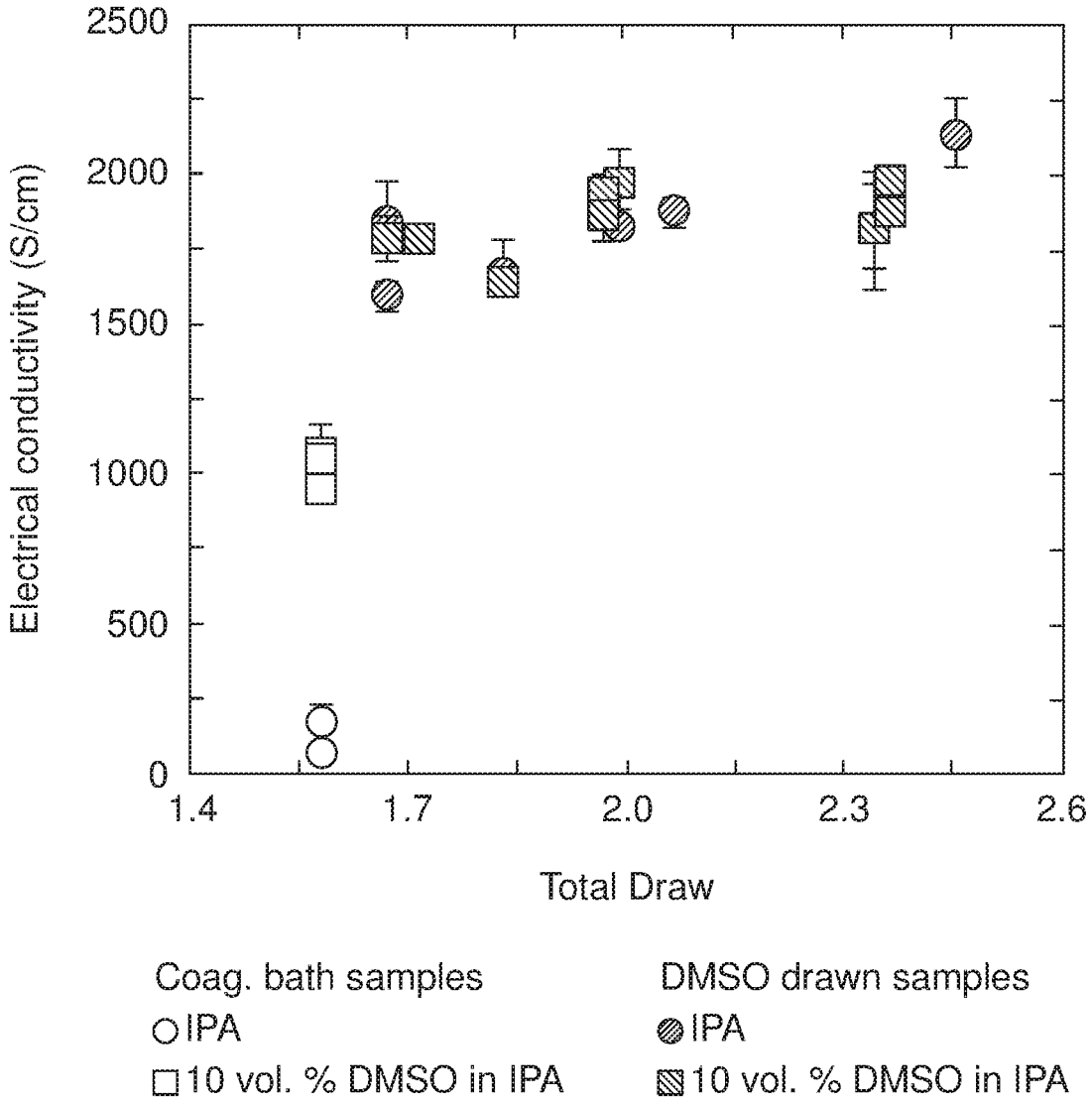
FIG. 3A illustrates electrical conductivity as a function of total draw.

FIG. 3A shows the electrical conductivity as a function of the total draw ratio. Adding 10 vol. % DMSO to the coagulation bath while keeping all else equal increased the electrical conductivity of the coagulation bath fibers by an order of magnitude from ~125 S $cm^{-1}$ to ~1030 S $cm^{-1}$. This increase in electrical conductivity is attributed to the secondary doping effect of DMSO in PEDOT:PSS. Secondary doping refers to the addition of an apparently inert material that induces structural changes in the organization of the polymer chains leading to conductivity increases up to several orders of magnitude. DMSO induced stronger π-π interactions between PEDOT chains which resulted in enhanced interchain carrier transport in the b-axis direction resulting in the overall increase of the electrical conductivity. Furthermore, the electrical conductivity of the fibers increased with increasing draw and saturated around 2000 S $cm^{-1}$ for total draws higher than 2. The π-π stacking distance remained constant at 3.4 Å, thus, the increase in electrical conductivity cannot be explained by stronger orbital overlap between PEDOT stacks. Instead, the increase in electrical conductivity can be attributed to the drawing-induced orientation of (100) and (020) planes, effectively aligning the PEDOT backbone parallel to the fiber axis direction. The electrical conductivity is likely to be the highest along the conjugated polymer backbone, thus aligning the chains improves the charge carrier transport in the fiber axis direction. It must be noted that DMSO induced stronger π-orbital overlap resulting in better interchain transport in the b-axis direction while drawing the fibers aligned the polymer backbones parallel to the fibers' axis. Interestingly, this resulted in a synergistic effect where the enhanced interchain transport occurs perpendicular to the fiber axis direction and the higher mobility intrachain transport occurs parallel to the fiber axis direction yielding the high electrical conductivities observed. Similar trends showing an increase in electrical conductivity with increasing draw or stretch have been previously reported for other conducting polymer fibers such as poly(3-alkylthiophenes) and polyaniline fibers.

Figure 3B:
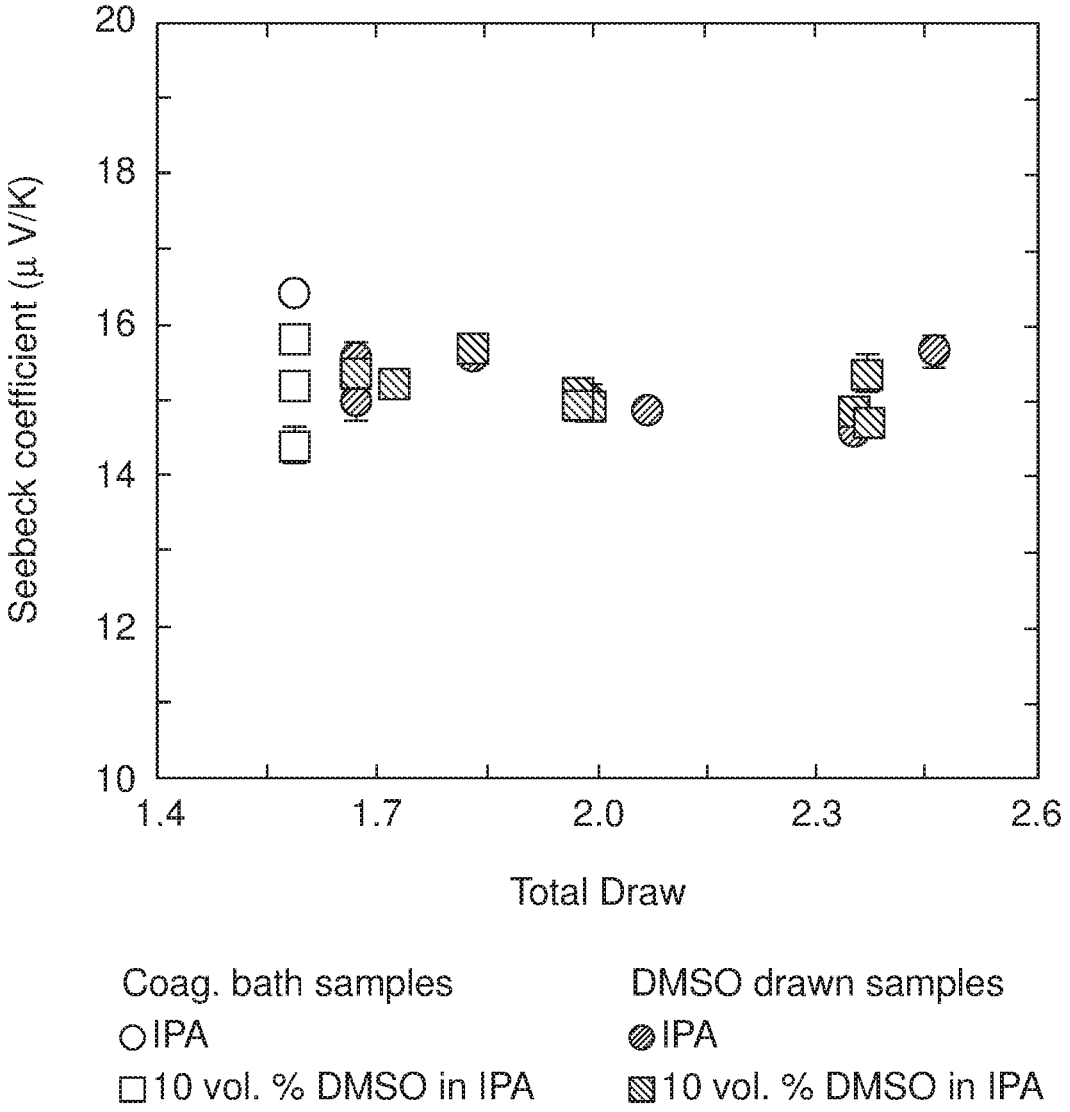
FIG. 3B illustrates Seebeck coefficient as a function of total draw.
Figure 3C:
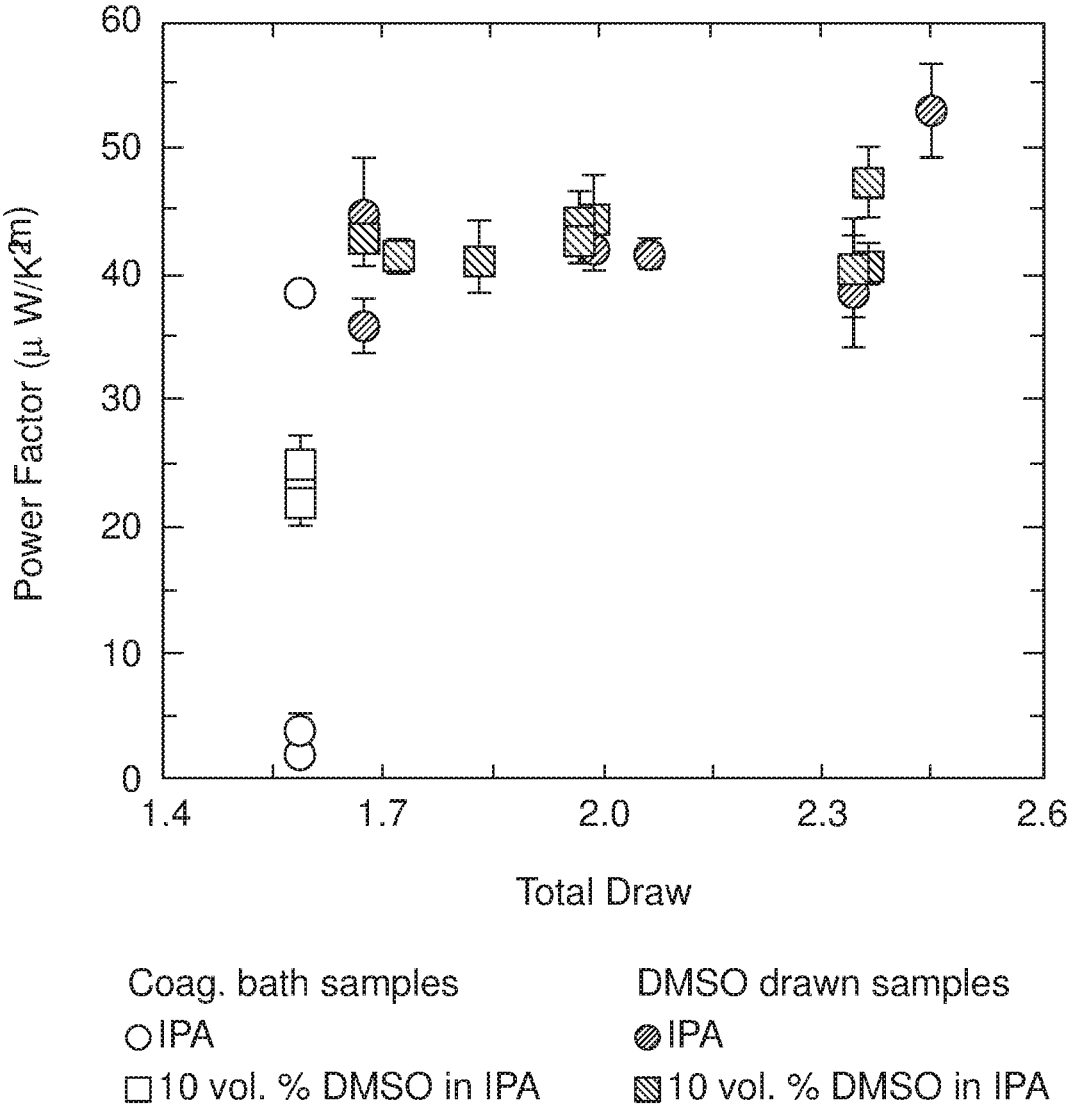
FIG. 3C illustrates power factor as a function of total draw.

On the other hand, the Seebeck coefficient remained practically constant across all the samples studied (see FIG. 3B). The Seebeck coefficient depends strongly on the charge carrier concentration of the polymer chains and, in general, it decreases with increased doping. Drawing the polymer chains did not change the charge carrier concentration but increased the mobility of the charge carriers due to orientation of crystal planes having little to no effect on the Seebeck coefficient. As a result of the increase in electrical conductivity and the constant Seebeck coefficient, the thermoelectric power factor, $\alpha^2\sigma$, increased following the same trend observed for the electrical conductivity and yielded maximum power factors in the range of 40-50 μW $m^{-1}$ $K^{-2}$ (see FIG. 3C).

The thermal conductivity of the fibers spun into 10 vol. % DMSO in IPA was also investigated. The desirable thermal conduction of an electrically conducting fiber for textile electronics is application dependent. For instance, from the point of view of electrical interconnections, high thermal conductivity is preferred to enhance heat dissipation and avoid hot spots that can ultimately lead to the interconnection failure. On the other side, for applications such as thermoelectric textiles a low thermal conductivity is preferable. Determining the thermal conductivity of materials in the fiber geometry and with diameters of less than 12 μm is challenging. Here, we used a self-heating technique that takes advantage of the electrically conducting nature of the fibers to determine the thermal conductivity at liquid nitrogen temperatures. The results are shown in FIG. 4. Here, the error bars include uncertainties due to thermal radiation and length uncertainties (~±10%) but are dominated by deviation from specimens within the same sample. The most likely cause of these deviations are damages in the specimens, possibly caused during mounting, in which case the largest value (i.e. ~top of the error bar) for each sample may be the best estimate. The measured thermal conductivities at liquid nitrogen temperature (2-6 W $m^{-1}$ $K^{-1}$) are an order of magnitude larger than conventionally found for PEDOT:PSS films at room temperature (typically between 0.2 and 0.5 W $m^{-1}$ $K^{-1}$). These results reflect the preferred orientation of both the PEDOT crystallites and PSS chains in the fiber axis direction as opposed to the random orientation typically found in films. Like the electrical conductivities, the non-DMSO stretched coagulation bath sample has the lowest thermal conductivity (~2.4 W $m^{-1}$ $K^{-1}$) while the stretched fibers all have thermal conductivities between 3 and 6 W $m^{-1}$ $K^{-1}$. For all samples, the measured total thermal conductivity is about a factor of 20 larger than the electronic thermal conductivity calculated from the Wiedemann-Franz law, indicating that the lattice contribution is still the dominant one despite the large electrical conductivities observed.

A typical temperature dependence of the resistance for fibers spun into 10 vol. % DMSO in IPA is shown in the inset to FIG. 4. The temperature dependence was similar for all samples at all the different total draws studied, with R(78 K)/R (300 K) varying between 1.32 and 1.38 in all cases. Note that the slope dR/dT becomes small near room temperature and, in fact, changes sign at higher temperatures (not shown), where the resistance value becomes history dependent. The weak overall temperature dependence suggests that the conduction mechanism is dominantly metallic conductivity in the heavily doped, crystalline PEDOT domains moderated by hopping between domains. We emphasize, however, that the temperature dependent measurements are for samples in vacuum, for which the sample is presumably dehydrated. In fact, the room temperature resistances of the specimens (reversibly) increased by between 5% and 11% between ambient atmosphere and vacuum.

Next, we investigated the single-filament tensile properties of the fibers. To fully understand the behavior observed in the mechanical properties, the difference in molecular weights between PEDOT and PSS must be considered. In the commercial product used in this study, the molecular weight of PEDOT ranges between 1000-2500 and the molecular weight of PSS is approximately 400000. Since PSS chains are much longer than PEDOT chains, we believe that PSS bears an immensely larger fraction of the applied mechanical stress. Having this fact in mind, we can proceed to analyze the mechanical behavior of the fibers. The Young's modulus as a function of total draw is presented in FIG. 5A. The coagulation bath samples had a Young's modulus of around 6 GPa, regardless if DMSO was present or not. It was discussed before that DMSO in the coagulation bath only induced stronger π-π interactions between PEDOT stacks, which did not modify the tensile stress bearing PSS chains. However, applying draw induced orientation of the PEDOT and PSS backbones along the fiber axis which resulted in higher Young's moduli at higher draw ratios reaching values as high as 15.6 GPa. This is higher than all the previously reported wet-spun PEDOT:PSS fibers and to the best of our knowledge the highest Young's modulus reported for a PEDOT:PSS material. The increase in Young's modulus came accompanied by the characteristic decrease in elongation at break that is usually observed for oriented polymer materials (see FIG. 5B). The break stress or tensile strength followed a similar trend to that of the Young's modulus reaching values as high as 425 MPa, however, with a larger dispersion (see FIG. 5C). The break stress is a function of the Young's modulus and the elongation at break and, thus, the dispersion in the latter properties gets magnified in the break stress. Overall, fibers that were spun into 10 vol. % DMSO in IPA as coagulation bath seem to have slightly higher Young's modulus and break stress.

Figure 5A:
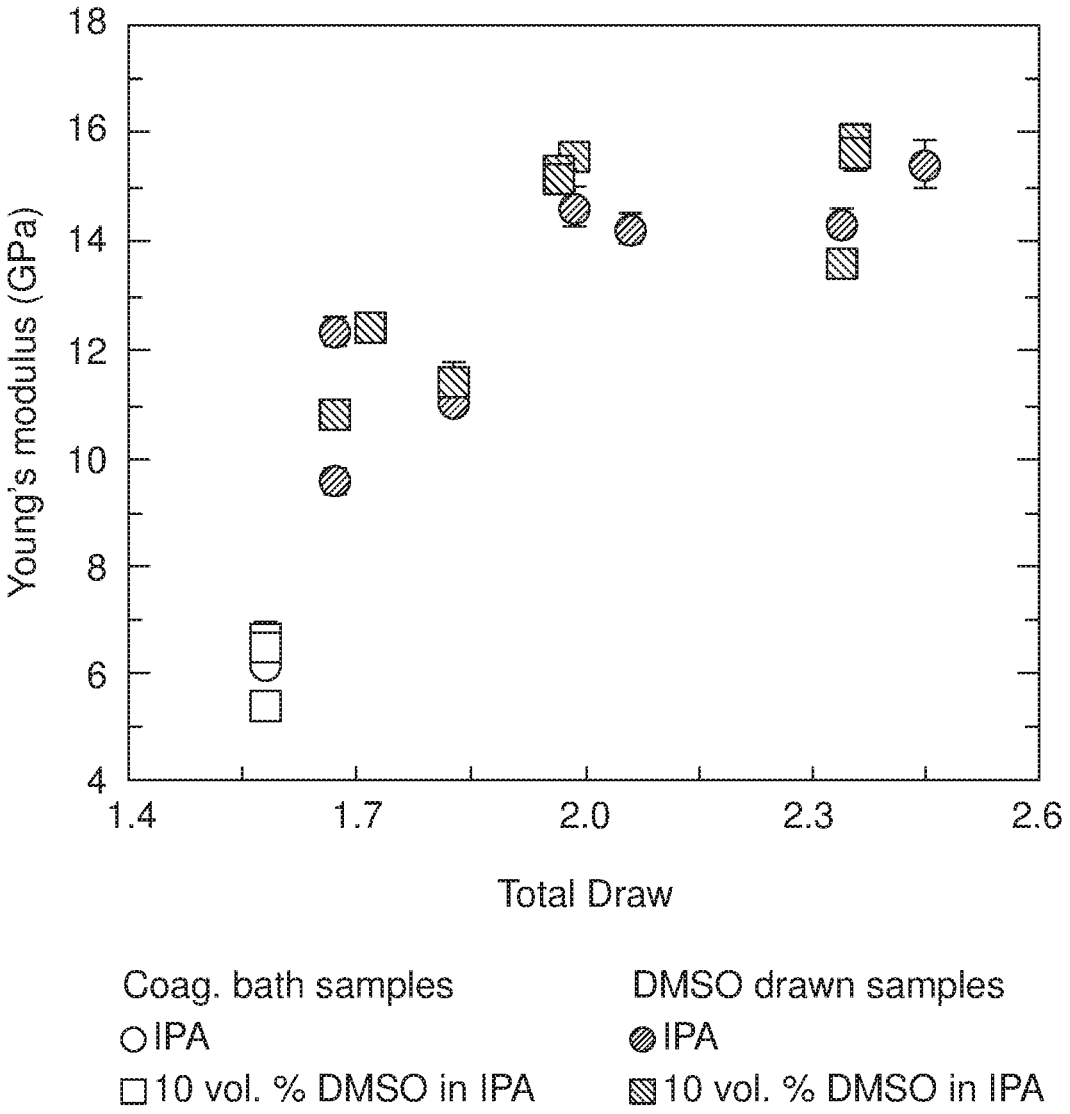
FIG. 5A illustrates single filament Young's modulus of PEDOT:PSS fibers as a function of total draw.
Figure 5B:
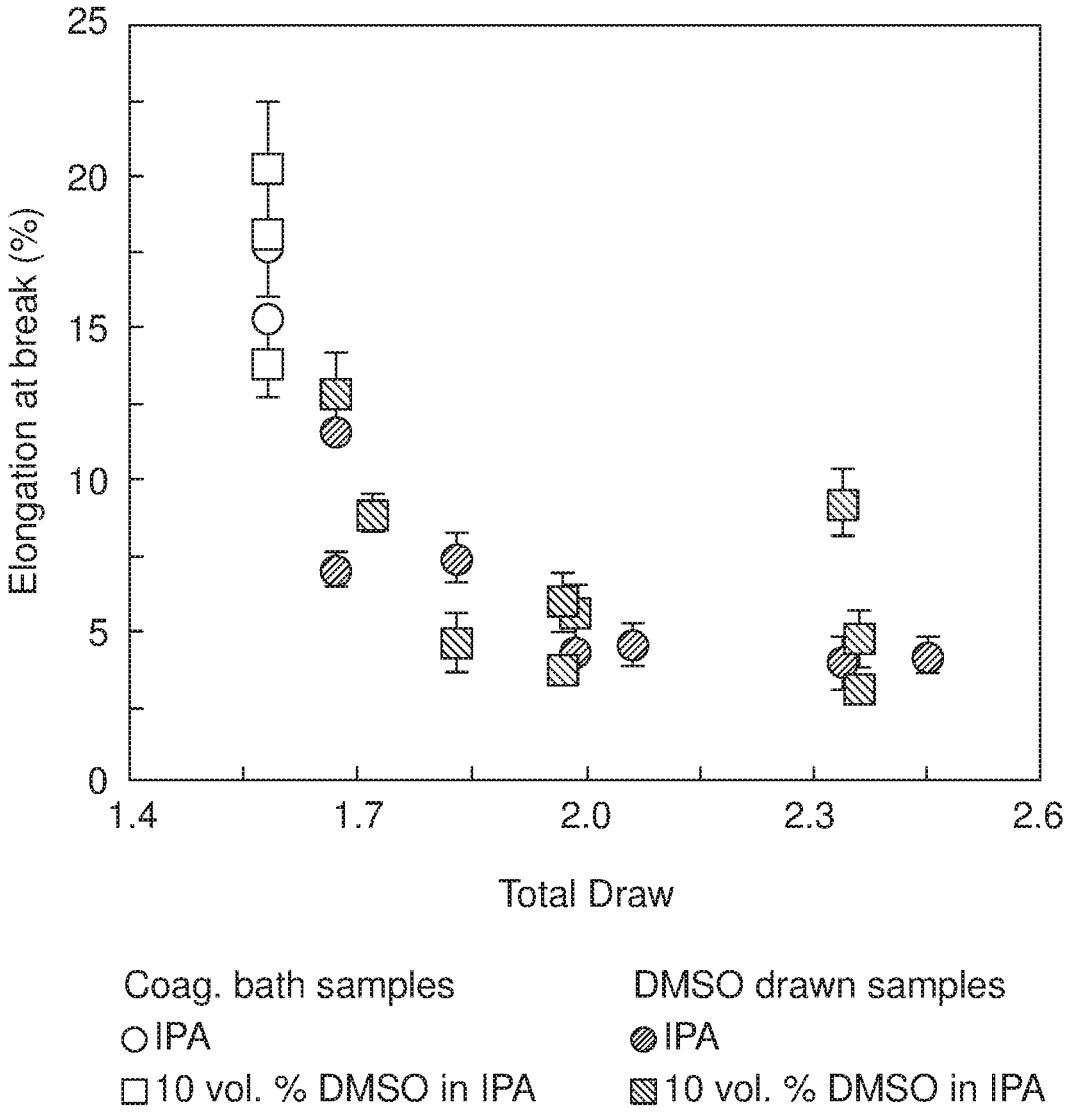
FIG. 5B illustrates single filament elongation at break of PEDOT:PSS fibers as a function of total draw.
Figure 5C:
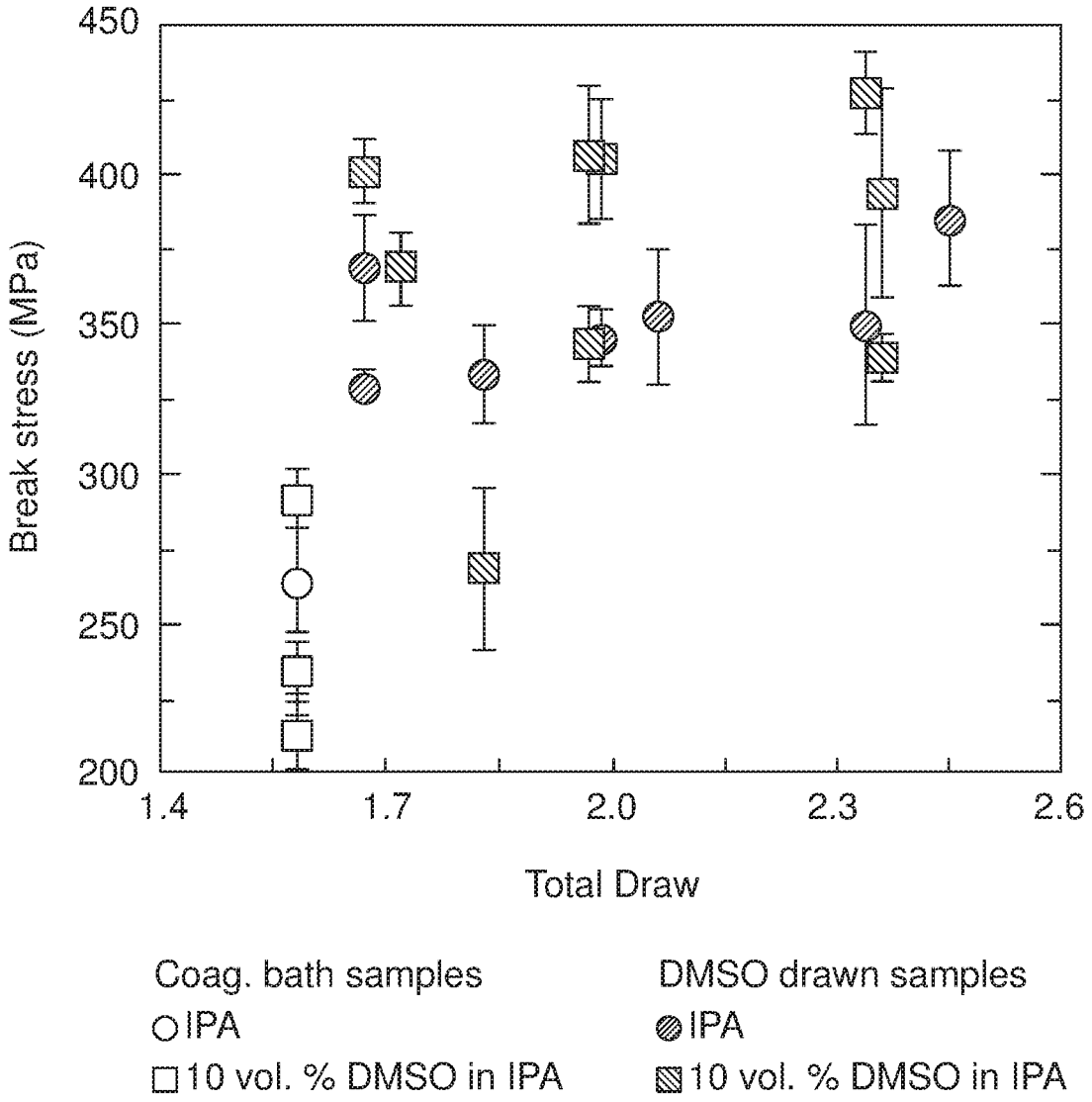
FIG. 5C illustrates single filament break stress of PEDOT:PSS fibers as a function of total draw.

From the discussions on the effect of increasing applied draw on the electrical conductivity and Young's modulus and by comparing FIGS. 3A and 5A, it was evident that the electrical conductivity and the Young's modulus follow a very similar trend. The electrical properties and mechanical properties are strongly correlated because they both are affected by inter- and intrachain interactions. In general, the mechanical properties of polymeric materials are highest along the polymer backbone, while in conducting polymeric materials, the electrical conductivity is also highest along the polymer backbone. Thus, alignment of the polymer chains along the axis of the fiber benefits both electrical and mechanical properties. In this study, the applied draw resulted in the orientation of (100) and (020) planes parallel to the axis of the fiber, thus aligning both PEDOT and PSS backbones in the fiber axis direction. In order to quantify the degree of orientation introduced by drawing the fibers and correlate it to the mechanical and electrical properties, we calculated the Hermans orientation factor for the (100) reflection using $$<\cos^2\psi_{c,Z}> = \frac{\int_0^{\pi} I(\psi)\sin\psi\cos^2\psi\, d\psi}{\int_0^{\pi} I(\psi)\sin\psi\, d\psi} \quad \text{eq. 2}$$

$$f_c = \frac{3<\cos^2\psi_{c,Z}> - 1}{2} \quad \text{eq. 3}$$

Figure 6A:
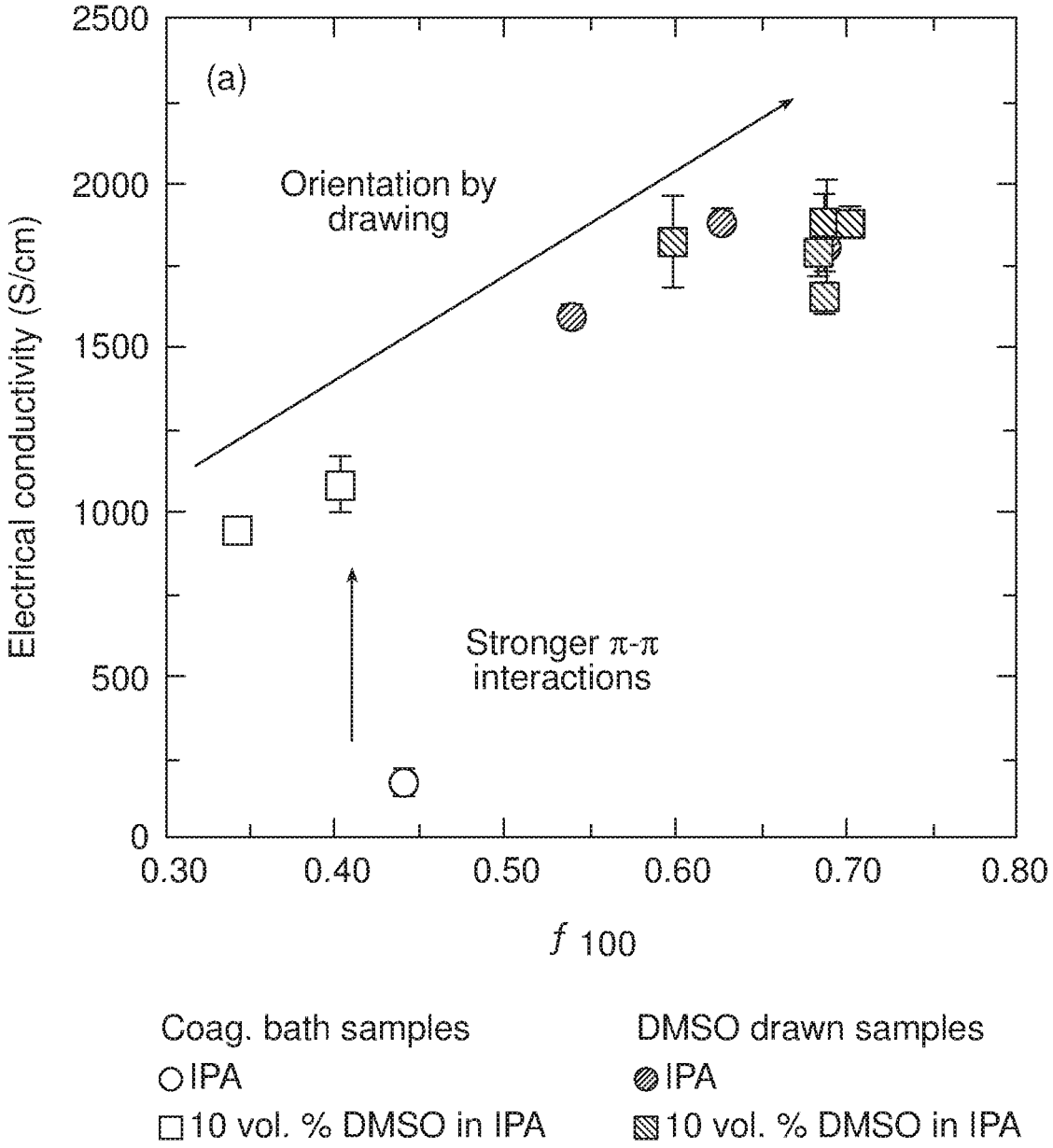
FIG. 6A illustrates electrical conductivity versus (100) Hermans orientation factor, $f_{100}$.
Figure 6B:
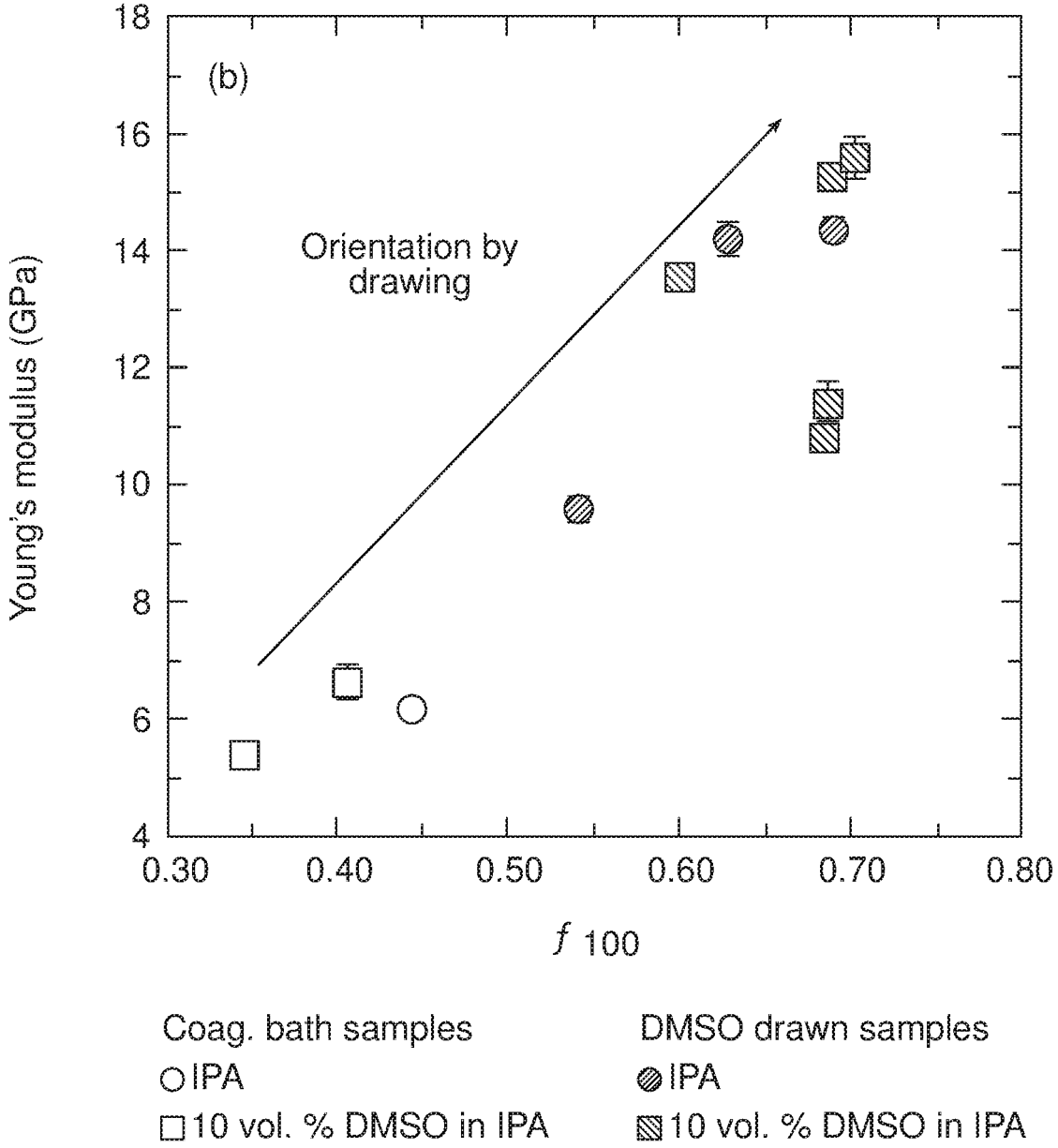
FIG. 6B illustrates Young's modulus versus (100) Hermans orientation factor, $f_{100}$.
Figure 6C:
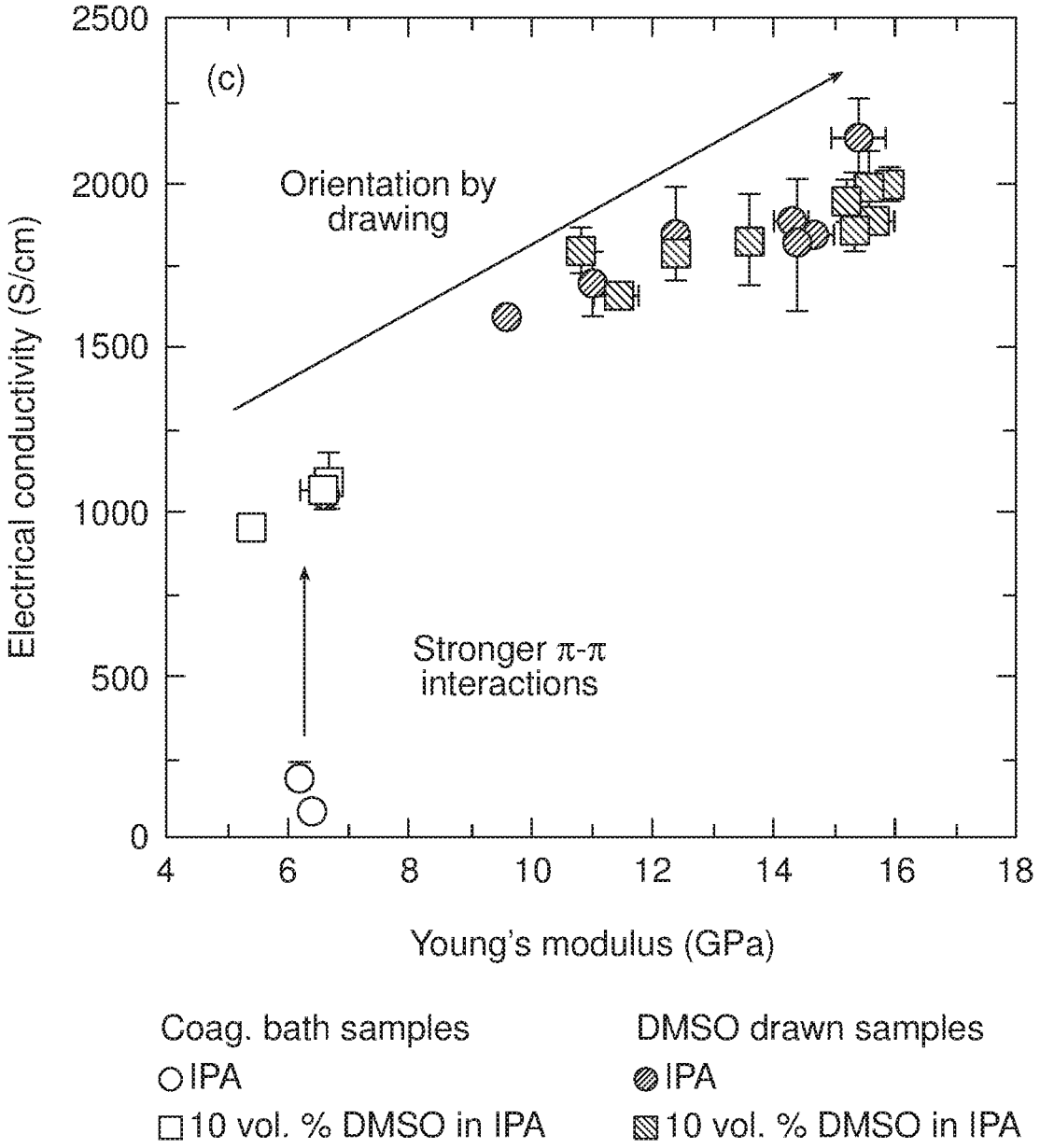
FIG. 6C illustrates electrical conductivity versus Young's modulus.

In these equations, ψ is the azimuthal angle, I(ψ) are the azimuthal intensities and $<\cos^2\psi_{c,Z}>$ is the average cosine square of the angle that the c-plane made with the draw direction, Z. $f_c$ takes values of 0 for an isotropic material with no orientation, −0.5 when the crystal planes are oriented perpendicular to the draw direction and 1 for fully oriented planes parallel to the draw direction. The PEDOT:PSS film showed no orientation with a calculated $f_{100}$ value of −0.01 while all fiber samples had some degree of orientation with values ranging from 0.30 to 0.70. FIGS. 6A and 6B show the electrical conductivity and Young's modulus as a function of $f_{100}$. On one hand, the DMSO-induced shortening of the π-π stacking distance of PEDOT increased the electrical conductivity but did not increase orientation in the coagulation bath samples, as demonstrated by the constant (and even smaller) values of $f_{100}$ (see bottom left corner in FIG. 6A). On the other hand, the drawing-induced orientation effectively aligned both PEDOT and PSS chains along the fiber axis, resulting in a linear increase of both electrical conductivity and Young's modulus. It must be noted that the increase in Young's modulus seems purely due to the drawing-induced alignment of the polymer chains as can be inferred from the absence of a step in FIG. 6B caused by the enhanced π-π interactions as opposed to the step observed for the electrical conductivity case. This interesting result supports the idea that the larger molecular weight PSS chains bear practically all the mechanical stress of the fibers. All the previous analysis is very well summarized in FIG. 6C that plots the electrical conductivity versus the Young's modulus showing that, in general, the highest conducting fibers were also the stiffest.

In this work, we have developed a continuous and scalable wet-spinning process for the production of PEDOT:PSS fibers that have high electrical conductivity, high thermal conductivity, excellent mechanical properties and moderate thermoelectric performance by including a DMSO drawing step following coagulation. On one hand, DMSO induced stronger π-π interactions between PEDOT chains while, on the other hand, the applied draw aligned the backbones of both PEDOT and PSS in the fiber axis direction. This synergistic effect resulted in room temperature electrical conductivities of approximately 2000 S $cm^{-1}$ and Young's moduli around 15.5 GPa at high applied draws. In fact, to the best of our knowledge, these Young's moduli are the highest for a PEDOT:PSS material reported to date. Additionally, the Seebeck coefficients were found rather constant with draw and moderate thermoelectric power factors around 40-50 μW $m^{-1}$ $K^{-2}$ were obtained at high draws. However, the high thermal conductivities of the fibers, measured at approximately 4-5 W $m^{-1}$ $K^{-1}$ in liquid nitrogen temperatures, affects negatively the ultimate thermoelectric performance, although it may be beneficial for other applications such as textile interconnections.

The foregoing has been presented for purposes of illustration and description. It is not intended to be exhaustive or to limit the embodiments to the precise form disclosed. Obvious modifications and variations are possible in light of the above teachings. All such modifications and variations are within the scope of the appended claims when interpreted in accordance with the breadth to which they are fairly, legally and equitably entitled.

What is claimed:

1. A method of wet-spinning poly (3,4-ethylenedioxythiophene):poly (styrenesulfonate) (PEDOT:PSS) fibers, comprising:

extruding a dispersion of PEDOT:PSS polymer in a polar solvent through a spinneret into a coagulation bath of non-solvent to PEDOT:PSS and a polar solvent having a boiling point above 100° C. to produce PEDOT:PSS;

taking up the PEDOT:PSS fibers out of the coagulation bath;

drying the PEDOT:PSS fibers as the PEDOT:PSS fibers are taken up from the coagulation bath;

drawing the PEDOT:PSS fibers in a stretch bath; and recovering drawn PEDOT:PSS fibers from the stretch bath.

2. The method of claim 1, including continuously processing the PEDOT:PSS fibers through the extruding, taking up, drying, drawing and recovering.

3. The method of claim 1, including providing between 1 to 10 weight percent solids in the dispersion of PEDOT:PSS polymers.

4. The method of claim 1, including 0.1-80% volume polar solvent and 20-99.9% volume non-solvent in the coagulation bath.

5. The method of claim 4, including selecting said polar solvent from a first group consisting of dimethyl sulfoxide, ethylene glycol, glycerol and combinations thereof and selecting said non-solvent from a second group consisting of acetone, isopropanol and combinations thereof.

6. The method of claim 1, including 0.1-20% volume polar solvent and 80-99.9% volume non-solvent in the coagulation bath.

7. The method of claim 6, including selecting said polar solvent from a first group consisting of dimethyl sulfoxide, ethylene glycol, glycerol and combinations thereof and selecting said non-solvent from a second group consisting of acetone, isopropanol and combinations thereof.

8. The method of claim 1, including 5-10% volume polar solvent and 90-95% volume non-solvent in the coagulation bath.

9. The method of claim 8, including selecting said polar solvent from a first group consisting of dimethyl sulfoxide, ethylene glycol, glycerol and combinations thereof and selecting said non-solvent from a second group consisting of acetone, isopropanol and combinations thereof.

10. The method of claim 1, using a rotating roller for the taking up of the PEDOT:PSS fibers.

11. The method of claim 10, wherein the drying of the PEDOT:PSS fibers is performed between the coagulation bath and the rotating roller.

12. The method of claim 11, using air having a temperature between 80 to 150° C. in the drying of the PEDOT:PSS fibers.

13. The method of claim 1, including maintaining the stretch bath at a temperature above 0° C. and below a boiling point of a polar solvent used in the stretch bath.

14. The method of claim 13, wherein the polar solvent used in the stretch bath has a boiling point above 100° C.

15. The method of claim 14, including selecting said polar solvent from a third group consisting of dimethyl sulfoxide, ethylene glycol, glycerol and combinations thereof.

16. A method of wet-spinning poly (3,4-ethylenedioxythiopene):poly (styrenesulfonate) (PEDOT:PSS) fibers, comprising:

extruding a dispersion of PEDOT:PSS polymer in a polar solvent through a spinneret in a coagulation bath of non-solvent to PEDOT:PSS;

taking up the PEDOT:PSS fibers out of the coagulation bath;

drawing the PEDOT:PSS fibers in a stretch bath of a polar solvent having a boiling point above 100° C.; and recovering drawn PEDOT:PSS fibers from the stretch bath.

17. The method of claim 16, including selecting the polar solvent from a group consisting of dimethyl sulfoxide, ethylene glycol, glycerol and combinations thereof.

18. The method of claim 17, wherein the stretch bath is maintained at a temperature between 0° C. and 150° C. while stretching the PEDOT:PSS fibers at a ratio between 0.9:1 and 5:1.

19. The method of claim 18, including selecting the non-solvent from a group consisting of acetone, isopropanol and combinations thereof.

* * * * *